United States Patent [19]

Davison

[11] Patent Number: 4,527,475

[45] Date of Patent: Jul. 9, 1985

[54] IMPRINTER PRINTHEAD AND SHUTTLE ASSEMBLY

[75] Inventor: Charles F. Davison, Brookfield, Ill.

[73] Assignee: Norwood Marking & Equipment Co., Inc., Downers Grove, Ill.

[21] Appl. No.: 491,523

[22] Filed: May 4, 1983

Related U.S. Application Data

[63] Continuation of Ser. No. 351,430, Feb. 23, 1982, abandoned.

[51] Int. Cl.[3] ..... B41F 5/00

[52] U.S. Cl. ..... 101/316; 101/292; 101/27

[58] Field of Search ..... 101/27, 41, 93.47, 292, 101/316

[56] References Cited

U.S. PATENT DOCUMENTS 1,028,226 6/1912 Kohnle ..... 101/292
2,523,430 9/1950 Hearn ..... 101/316

FOREIGN PATENT DOCUMENTS 538229 3/1957 Canada ..... 101/42

*Primary Examiner*—Edgar S. Burr
*Assistant Examiner*—John A. Weresh
*Attorney, Agent, or Firm*—Hill, Van Santen, Steadman & Simpson

[57] ABSTRACT

An intermittent motion imprinter of the type having a reciprocal marker head suspended from a shaft, an opposed anvil, tape supply and take-up reels, a tape advance mechanism and a reciprocal shuttle driving the head and tape advance mechanism, has a common holder for the head shaft and shuttle with intersecting closed periphery slots respectively receiving and guiding the shuttle and the head shaft. The holder is a two-piece split block defining, when assembled, a transverse slot for the shuttle and an upright slot for the head shaft. A cam follower on the head shaft projects into an inclined slot of the shuttle so that, as the shuttle is reciprocated, the shaft is raised and lowered. A second cam follower is also driven by the shuttle to actuate the tape advance mechanism. In one form, the second cam follower is directly attached to the shuttle. In another form, the second cam follower rides in a second shuttle slot. In one form the shuttle rides in a groove provided in one piece of the split block of the holder with the head shaft riding in a groove provided in the opposite block of the holder. In another form, only one holder block is grooved, receiving both the shuttle and the head shaft with the shaft also being grooved to receive the shuttle.

8 Claims, 10 Drawing Figures

IMPRINTER PRINTHEAD AND SHUTTLE ASSEMBLY

This is a continuation of application Ser. No. 351,430, filed Feb. 23, 1982, now abandoned.

BACKGROUND OF THE INVENTION

1. Field of the Invention

This invention relates to intermittent motion imprinters and particularly to holder constructions for the head shaft and shuttle of intermittent motion transfer tape imprinters.

2. Description of the Prior Art

Intermittent motion transfer tape imprinters commonly have a reciprocating heated marker head with raised printing indicia pressing a heat sensitive pigmented tape or foil against the product to be printed as the product passes over an anvil. The head must be moved out of contact with the tape except during the imprinting operation. This requires a relatively large stroke of movement toward and away from the anvil relative to the thickness of the transfer tape, and this movement must be free from sway or any movement other than directly toward and away from the anvil in order to provide smear-free prints. Since the pigment of the tape acted on by the raised indicia of the heat is entirely transferred to the product, any restrike of that area of the transfer tape results in an incomplete print and it is, therefore, necessary to completely advance the tape between each strike. Ideally, the tape advancement is achieved on the retracting stroke of the marker head.

To allow for quick replacement of the transfer tape, tape cassettes have been provided for quick attachment to and removal from the imprinter.

Linkages and tape drive mechanisms have been provided for imprinters to reciprocate the marker head and to advance the tape, examples of which are found in U.S. Pat. Nos. 4,121,520 and 4,160,410. The copending application of James L. Shenoha, Ser. No. 158,632, filed June 11, 1980 now U.S. Pat. No. 4,373,436, issued Feb. 5, 1983, assigned to the assignee of this application also discloses and claims a marker head and tape drive marketed by the assignee.

The prior known linkages and drive mechanisms were somewhat bulky and complicated, and since it is very desirable to provide small compact imprinters occupying relatively little space on production machinery, it would be an improvement in the art to simplify and reduce the size of the linkages and drive mechanisms, especially in the area of the holders for a reciprocal shuttle driving the head and tape advance mechanism.

SUMMARY OF THE INVENTION

According to this invention, an intermittent motion transfer tape imprinter has a reciprocal marker head suspended from a shaft, an opposed anvil, tape supply and tape take-up reels, a tape advance mechanism, and a single reciprocal shuttle driving the head and tape advance mechanism. Preferably, the shaft is square or rectangular and the shuttle is a flat sided strip or rectangular plate. A simple compact holder slidably guides and supports the head shaft and shuttle preventing sway and eliminating heretofore required components. This single or common holder conveniently takes the form of a split block having two mating pieces defining, when assembled, a transverse flat sided closed periphery slot for the shuttle and an upright flat sided closed periphery slot for the shaft of the marker head. These closed periphery slots embrace the shuttle and shaft providing extensive guide surfaces which hold the shuttle and shaft against any unauthorized movements. The shuttle is reciprocated by a power cylinder and, in turn, has an inclined slot embracing a cam follower on the head shaft so that as the shuttle is reciprocated, the marker head will be raised and lowered. This shuttle also drives a second cam follower which actuates the tape advance mechanism and for this purpose, a second cam follower can either be directly attached to the head end of the shuttle adjacent the power cylinder, or can ride in an upright slot in the tail end of the shuttle. The two-piece block holder has the bearing walls for the shuttle and head shaft accurately machined to embrace substantial areas of the shuttle and shaft in a good bearing fit to avoid any unauthorized rocking or swaying.

It is, therefore, an object of this invention to simplify and reduce the size of support devices for drive mechanisms on intermittent motion imprinters.

Another object of this invention is to provide intermittent motion transfer tape imprinters with a split block holder mechanism driving the marker head and tape advance drive thereof.

A specific object of this invention is to provide a common holder for the marker head shaft and shuttle of an intermittent motion transfer tape imprinter.

Another specific object of this invention is to provide a two-piece split block holder for the reciprocating shuttle and marker head shaft of an intermittent motion imprinter.

Other and further objects of this invention will be understood from the following detailed description of the annexed sheets of drawings which show two preferred embodiments of the invention.

ON THE DRAWINGS

AS SHOWN ON THE DRAWINGS

Figure 1:
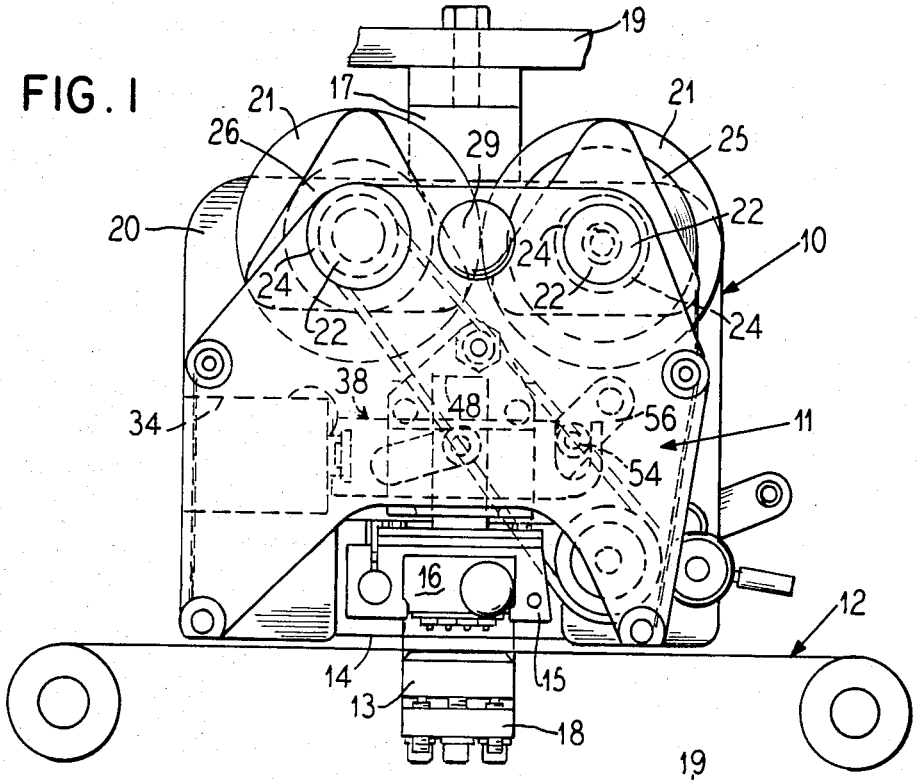
FIG. 1 is a front elevational view of an imprinter with a tape cassette in place on the front face thereof, and showing in dotted lines the underlying shuttle and marker head shaft holder of this invention.

The imprinter 10 and assembled cassette 11 of FIG. 1 is illustrated in position for printing data such as code dating, weight, price, and the like information on a run of packaging material or the like 12. The run 12 extends over an anvil 13 of the imprinter and under a run of transfer tape 14 mounted on the imprinter. An electrically heated reciprocating head 15 mounts a removable print block 16 with raised indicia above the tape run 14 to print pigment from the tape on the product 12 as it rests on the anvil 13.

The imprinter 10 has an upstanding mounting bracket 17 on the back side thereof with a horizontal bottom leg 18 supporting the anvil 13. The upper end of the vertical or upstanding bracket 17 is secured to a top frame plate 19 of packaging machinery or the like on which the imprinter is to operate.

Figure 2:
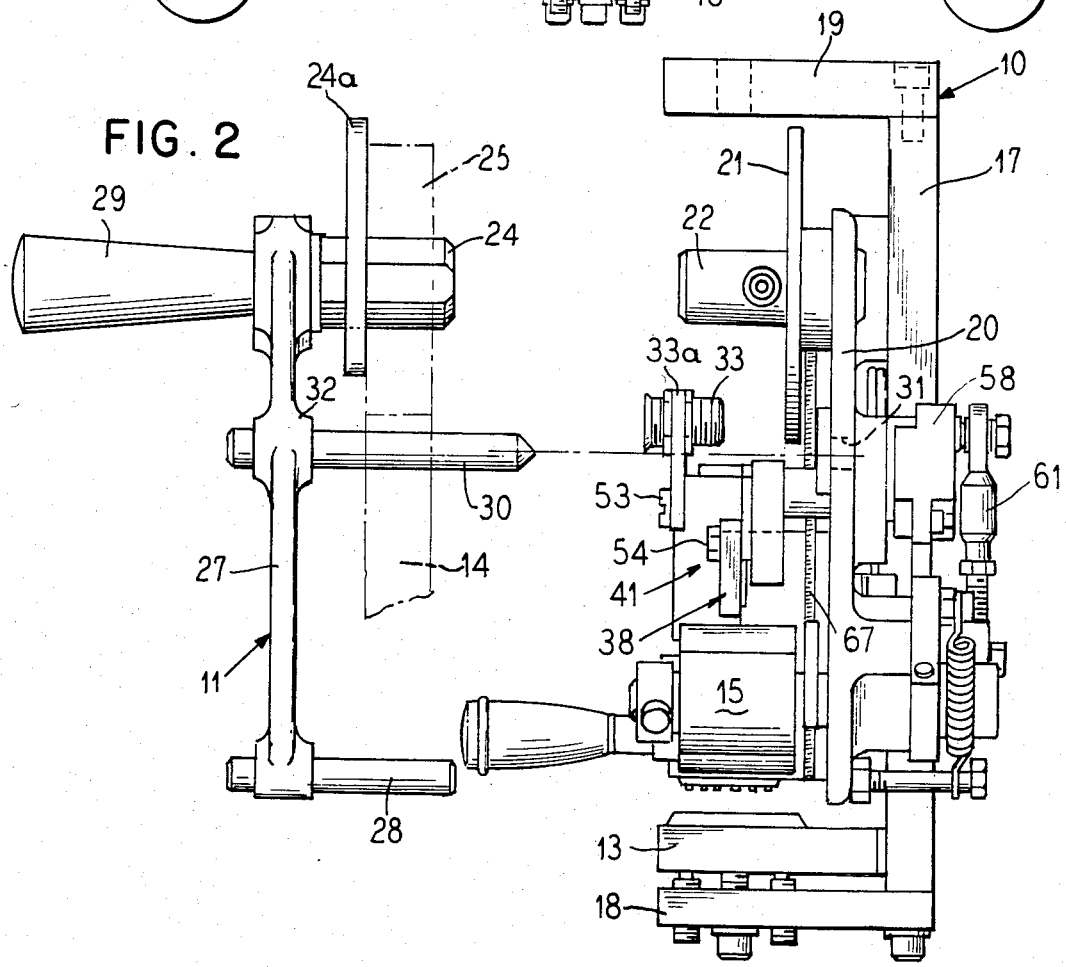
FIG. 2 is a side elevational view of the imprinter of FIG. 1 with the cassette separated from the main imprinter.
Figure 6:
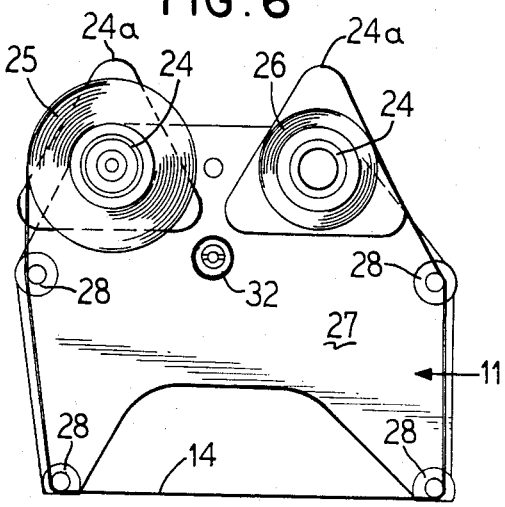
FIG. 6 is a rear elevational view of the cassette for the imprinter.

A main upstanding frame plate 20 is mounted on the bracket 17. This plate supports circular discs 21 in side-by-side relation at the top of the plate from which project stud shafts 22 onto which are telescoped cassette hubs 24 which receive therearound a take-off roll 25 and a wind-up roll 26 of the tape 14. The cassette 11, as best shown in FIG. 6, has an upstanding plate 27 from which the hubs 24 project. Each hub is backed by a triangular plate **24*a* forming a back support for the reels of tape. Pins 28 also project from the plate 27 below the hubs 24 to receive the tape therearound and provide the tape run illustrated at 14 over the product 12 to be stamped and the anvil 13, as shown in FIG. 1. A handle 29 (FIG. 2) projects outwardly from this plate 27 to facilitate mounting and demounting of the cassette 11. An alignment pin 30 projects inwardly from the plate 27 to seat in a hole 31 of the main frame plate 20 of the imprinter. The cassette is secured to the imprinter through a push-pull locking member 32 (FIG. 6) seating in a socket 33 (FIG. 2) carried by a plate 33*a*** on the imprinter.

Figure 3:
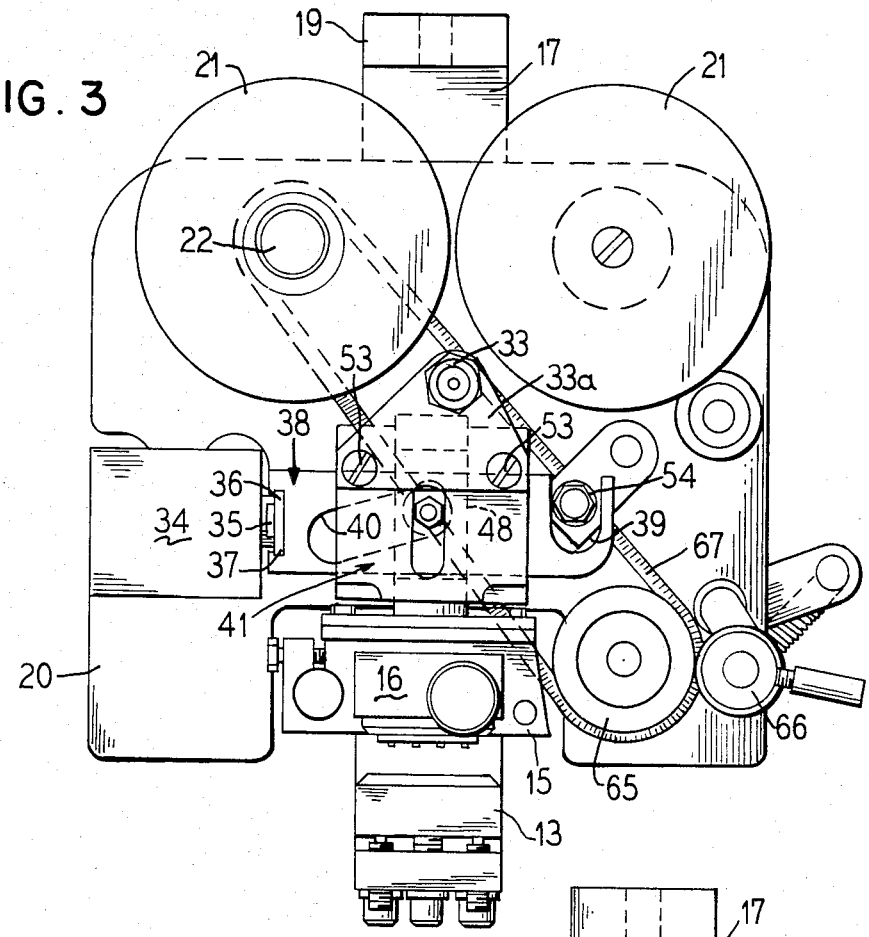
FIG. 3 is a front elevational view of the imprinter similar to FIG. 1 but with the cassette removed.
Figure 5:
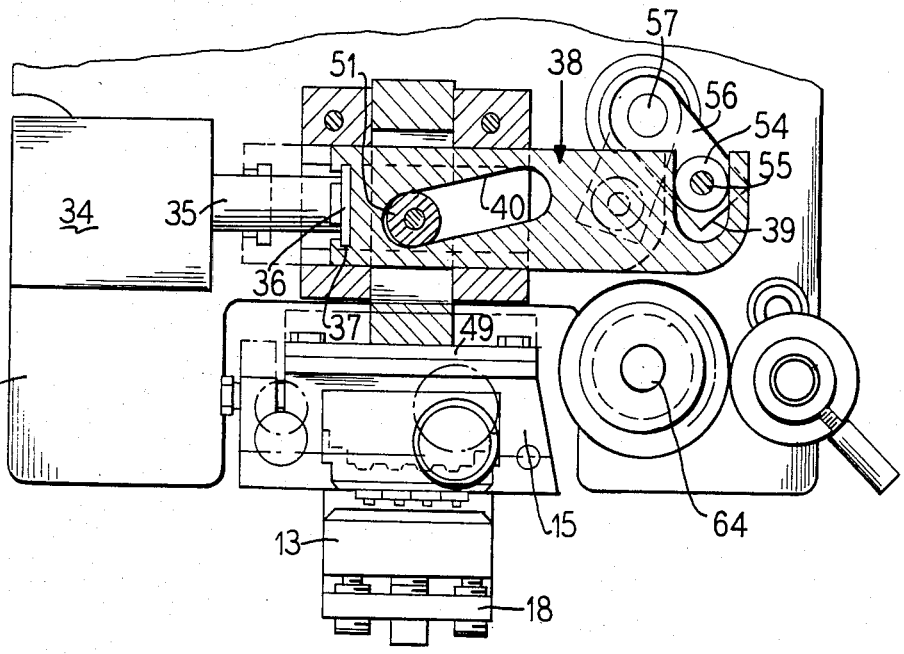
FIG. 5 is a somewhat enlarged fragmentary view with parts in vertical section showing the shuttle drive and holder.

A pneumatic cylinder 34 as best shown in FIGS. 3 and 5, is mounted on the front face of the plate 20 and has a piston rod 35 projecting therefrom with an enlarged head 36 seated in a slot 37 in the end of a horizontal shuttle 38. The opposite end of the shuttle has an open top slot or groove 39 and an upwardly inclined closed end slot 40 is provided in the shuttle 38 intermediate the ends 37 and 39.

Figure 8:
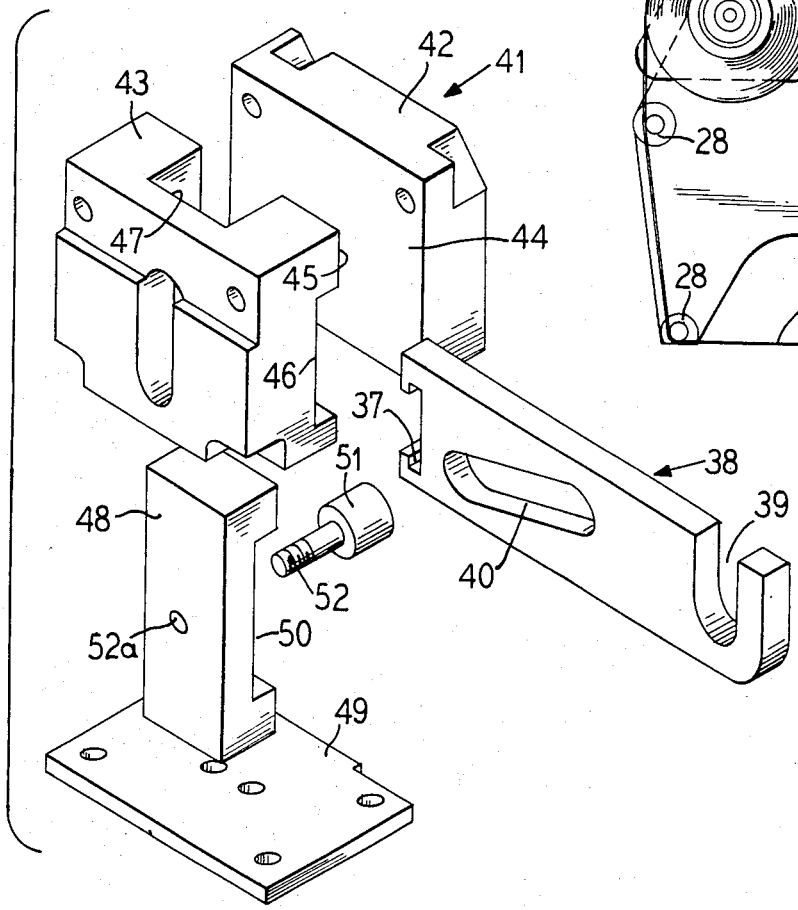
FIG. 8 is an exploded isometric view showing the component parts of FIG. 7.
Figure 7:
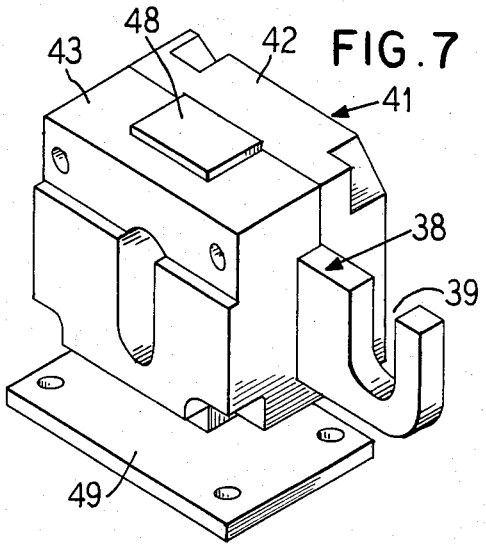
FIG. 7 is an isometric view of the assembled holder, shuttle and marker head shaft of this invention.

As best shown in FIGS. 7 and 8, the shuttle 38 is a flat rectangular strip slidably mounted in the holder 41 of this invention. This holder 41 is composed of two bolted together metal blocks 42 and 43. The block 42 has a front bearing face 44. The opposed face 45 of the block 43 has a shallow horizontal slot or groove 46 extending across the full width thereof and a deeper vertical slot or groove 47 extending the full height thereof. These slots or grooves 46 and 47 have flat side and bottom walls and when the faces 44 and 45 of the blocks 42 and 43 are bolted together, the slots or grooves define closed periphery bearing walls enveloping respectively the shuttle 38 and an upstanding rectangular shaft 48, the bottom end of which is secured to a pedestal plate 49 from which the heated block 15 depends. The shaft 48 is also transversely slotted or grooved at 50 to receive the shuttle 38 and, like the slots 46 and 47, this slot 50 is closed by the front face 44 of the block 42.

A cam follower 51 mounted on a pin 52 which is threaded into a tapped hole **52*a* of the shaft 48 rides in the shuttle slot 40. When the shuttle 30 is reciprocated by the pneumatic cylinder 34, the shaft 48 will be raised and lowered by the cam follower 51 riding in the inclined slot 40** of the shuttle.

The holder 41 is bolted to the frame plate 20 by bolts 53 which also secures the blocks 42 and 43 together and secure the plate **33*a* carrying the socket 33** to the holder.

Figure 4:
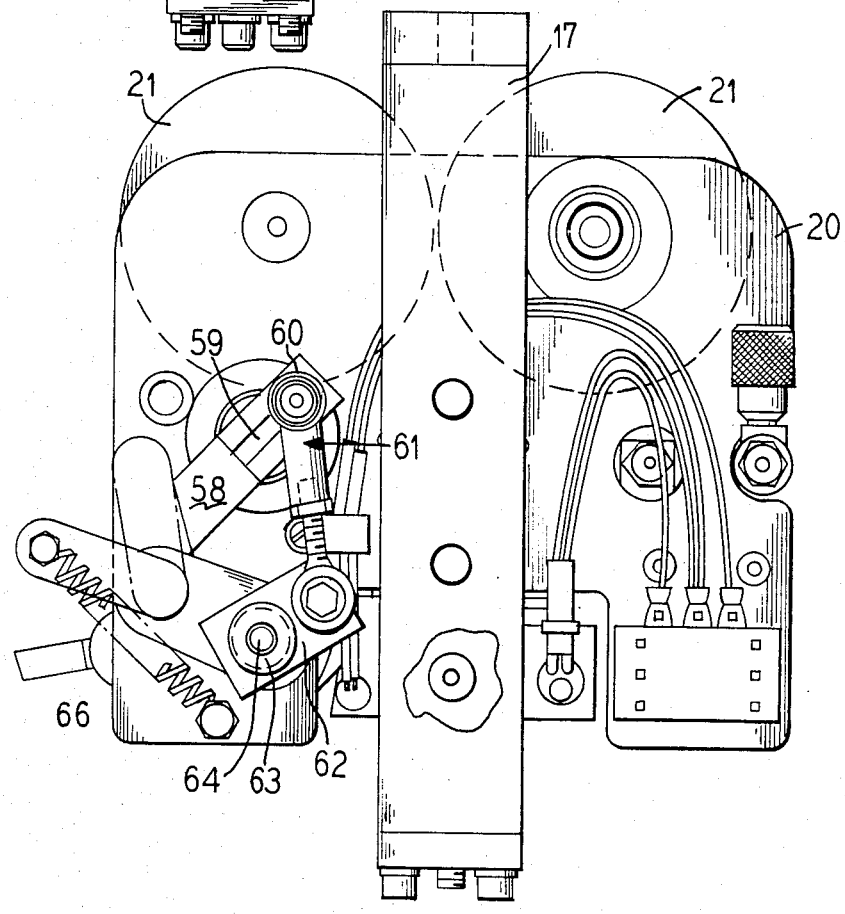
FIG. 4 is a back elevational view of the imprinter.

A cam follower 54 (FIG. 5) rides in the slot 39 of the shuttle 38 and is carried on a pin 55 projecting from an arm 56 of a tape drive crank. The arm 56 is fixed to a shaft 57 rotatably mounted in the plate 20, and a link 58 is secured to this shaft on the opposite face of the plate 20 as shown in FIG. 4. This link 58 has a groove 59 into which is fitted a nut 60 driving a toggle bolt 61 which in turn rocks an arm 62 connected through a one-way clutch 63 with a shaft 64 extending through the plate 20 and, as shown in FIG. 3, driving a grooved roller 65.

A pinch roller 66 is spring biased toward the roller 65. A spring belt 67 wrapped around the drive roller 65 and acted on by the pinch roller 66 drives the stud shaft 22 which in turn drives the hub 24 of the take-up reel 26.

By this linkage, when the shuttle 38 is reciprocated, the follower 54 rocks the crank 56 which in turn rotates the shaft 57 causing clockwise movement of the slotted member 58 which in turn drives the turn buckle to move the link 62 in a clockwise direction, but this movement is not transmitted to shaft 64 because the one-way clutch does not drive the shaft in this direction. However, inclined slot 40 of the shuttle drives the follower 51 to lower the marker head against the transfer tape, pressing it against the product 12 over the anvil 13, and effecting an imprinting of the indicia from the print head through the tape onto the product. Upon return of the shuttle to the left from the position illustrated in FIG. 5, movement of the crank 56 is in the reverse direction, and the one-way clutch will drive the shaft 64 thereby rotating the pulley 65 and driving the take-up reel to advance the tape. In the meantime, however, the print head will have been raised off of the tape.

The holder 41 by completely enveloping both the shuttle 38 and the shaft of the print head, provides extended bearing surfaces which hold these sliding parts in exact position to prevent any sway or deviation from their intended paths which may cause bonding of the shuttle, particularly at the extreme positions of its movement. The bearing faces provided by the holder, being extensive, distribute the loads over a wide area to minimize wear.

Figure 9:
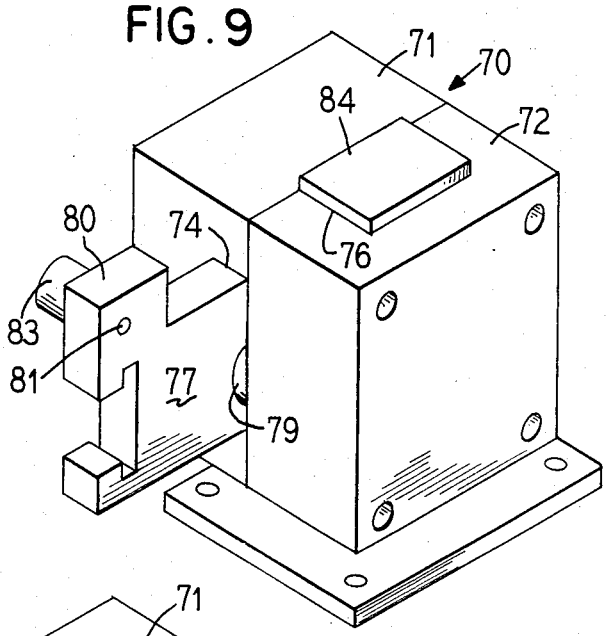
FIG. 9 is an isometric view similar to FIG. 7, but showing an alternate arrangement.
Figure 10:
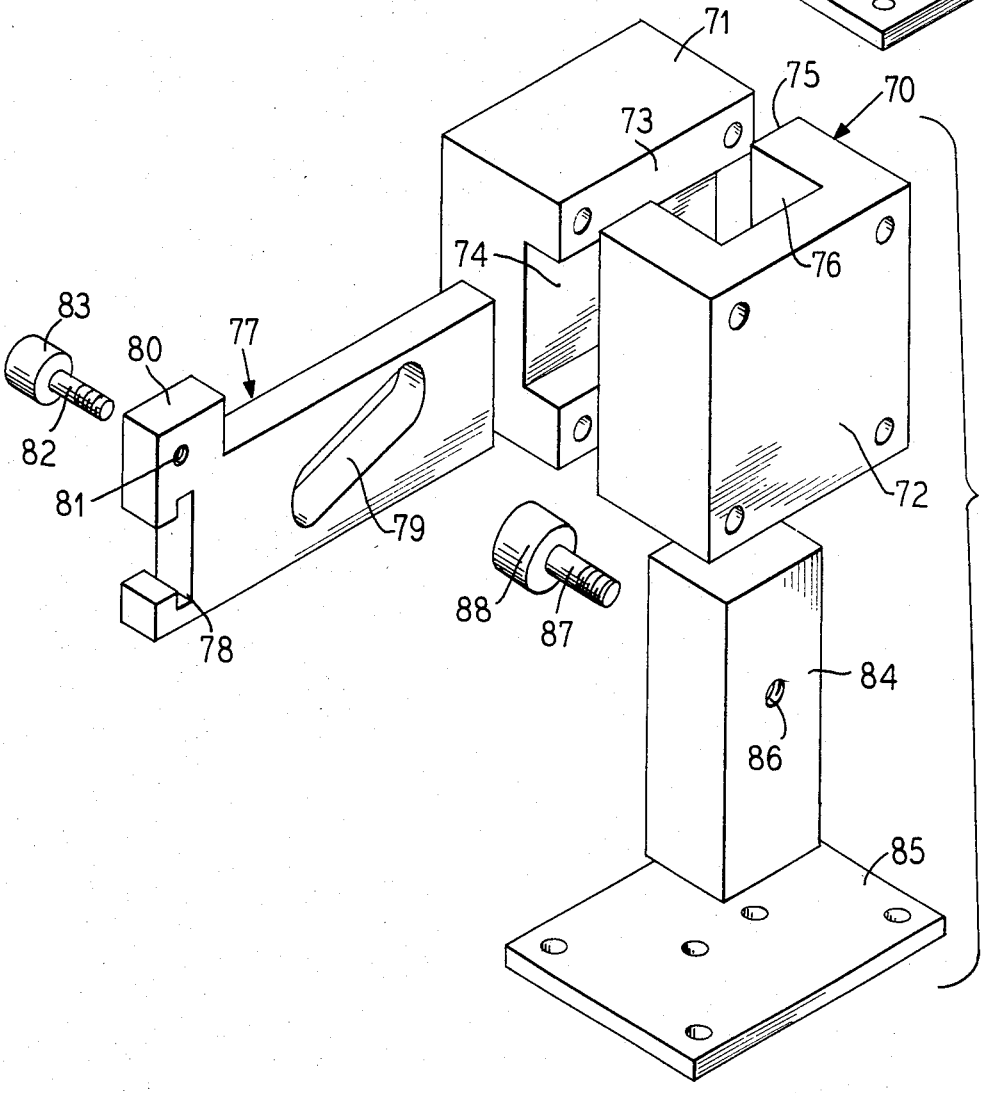
FIG. 10 is an exploded isometric view of the components of FIG. 9.

The modified holder 70 of FIGS. 9 and 10 functions in the same manner as the holder 41 and accommodates a somewhat different cam follower drive from the shuttle to the tape drive.

As shown in FIGS. 9 and 10, the holder 70, like the holder 41, is composed of a pair of metal blocks 71 and 72 bolted together in face-to-face relation. However, the face 73 of the block 71 has a horizontal slot or groove 74 cut thereacross with a flat bottom and flat sides. The block 72 and its face 75 confronting the face 73 is formed with a deeper slot or groove 76 extending from the top to the bottom thereof, and like the slot 74, having flat bottom and side walls.

When the blocks 71 and 72 are assembled as shown in FIG. 9, a closed periphery horizontal slot 74 and a closed periphery vertical slot 76 extend therethrough.

A somewhat modified rectangular shuttle 77 extends through the slot 74. Like the shuttle 38, the shuttle 77 has a grooved end 78 for receiving the head of the air cylinder plunger or piston rod, and also has an inclined slot 79 intermediate the ends thereof. However, the tail end of the shuttle 77 does not have the open top slot 39 of the shuttle 38, but instead an upstanding lug 80 is provided on the slotted end 78 of the shuttle. This lug has a tapped hole 81 receiving the threaded end of a pin 82 carrying a cam follower 83. The cam follower 83 performs the same function as the above described cam follower 54.

The deep vertical slot 76 of the holder 70 receives a square or rectangular marker head shaft 84 which is thicker than the shaft 48 of the arrangement of FIG. 7, but the pedestal 85 of this shaft 84 is bolted to the marker head in the same manner as described above.

The shaft 84 has a tapped hole 86 receiving the threaded end of a pin 87 carrying a cam follower 88 which rides in the shuttle slot 79 to reciprocate the shaft 84 in the same manner as described hereinabove.

The arrangement of FIGS. 9 and 10 provides the supporting slots 74 and 76 completely in the two blocks 71 and 72, thereby eliminating the slot 50 of the shaft 48 in the arrangement of FIGS. 7 and 8.

The holder 70 of FIGS. 9 and 10 affords the same substantial bearing support for the marker shaft and the shuttle as is provided in the arrangement of FIGS. 7 and 8.

From the above descriptions, it should be understood that this invention now provides a simplified substantial holder and bearing support for the shuttles and marking head shafts of imprinters.

I claim as my invention:

1. In an imprinter having a reciprocating marker head with an upstanding head shaft, an opposed anvil, tape supply and take-up reels, a tape advance drive and a driven slotted shuttle having flat sides and rectangular cross-section reciprocating between two extreme positions, said head shaft carrying a cam follower riding in the shuttle slot to drive said marker head, and a second cam follower driven by the shuttle for driving said tape advance drive, said shuttle and said head shaft being received in and guided by a bearing block, the improvement of a means for eliminating binding of said shuttle at said extreme positions comprising:

said head shaft having flat sides and a rectangular cross-section and having a rectangular slot receiving said shuttle;

and said bearing block having perpendicular rectangular intersecting slots respectively receiving and guiding said head shaft and said shuttle with respective flat surfaces of said head shaft and said shuttle sliding against each other in reciprocating perpendicular movement.

2. In the imprinter of claim 1, the further improvement of said bearing block comprising two components with the first component having said intersecting slots, and the second component covering the slots cooperating with the first component to define two closed periphery slots.

3. The imprinter of claim 1, wherein the bearing block is composed of two mating components in face-to-face engagement with a first component having a transversely extending flat sided groove forming said slot receiving the shuttle, and the second component having a flat sided groove forming said slot receiving the head shaft and with the first component closing the periphery of the head shaft receiving groove with the second component closing the periphery of the shuttle receiving groove to provide two closed periphery slots for the shuttle and shaft.

4. In an imprinter of the type having a main frame, a reciprocating marker head with an upstanding flat-sided rectangular cross-section shaft, an anvil opposite said head, tape supply and take-up reels, guides directing a run of tape from said reels between said head and anvil, a tape advance drive, and a flat-sided rectangular cross-section shuttle reciprocating between two extreme positions and having an inclined slot, the improvements for eliminating binding of said shuttle at said extreme position, of a split metal block mounted on said frame having first and second components bolted together in face-to-face relation and cooperating to define a first closed periphery slot having a rectangular cross-section embracing and slidably engaging the shuttle in non rotatable relation around the entire periphery thereof and a second closed periphery slot having a rectangular cross-section embracing and slidably engaging said shaft in non rotatable relation around the entire periphery thereof, said first and second closed periphery slots guiding said shuttle and said head shaft in perpendicular reciprocating movement in face-to-face sliding engagement, a cam follower mounted on said shaft riding in said inclined slot of the shuttle and power means reciprocating said shuttle in said first slot while simultaneously causing the inclined slot of the shuttle to reciprocate the shaft in the second slot, and the walls of the first and second components of the bearing block defining said first and second slots providing extensive bearing surfaces to precisely guide the shuttle and shaft without permitting rotation thereof.

5. The imprinter of claim 4, wherein one component of the block has a flat sided upright groove and a flat sided transverse groove intersecting said upright groove and the second component has a flat mating face closing said transverse and upright grooves to form said closed periphery slots.

6. The imprinter of claim 4, wherein the bearing block has one component with a flat sided open face transverse groove and the second component has a flat sided open face upright groove, and the mating faces of the components closing the open faces of the grooves to provide said closed periphery slots.

7. In an imprinter of the type having a main frame, a power cylinder driven flat faced rectangular cross-section reciprocating shuttle moving between two extreme positions, a reciprocating marker head driven by the shuttle and a tape advance mechanism also driven by the shuttle, the improvements for eliminating binding of said shuttle at said extreme positions, of a flat faced rectangular cross-section marker head shaft positioned in face-to-face sliding engagement with said shuttle, a split bearing block mounted on said main frame having a first closed periphery flat faced rectangular cross-section slot surrounding and slidably engaging said flat faced shuttle and a second closed periphery flat faced rectangular cross-section slot surrounding and slidably engaging said flat faced shaft, said shuttle having an inclined slot, a first cam follower on said shaft riding in said inclined slot of the shuttle to reciprocate the shaft perpendicularly to said shuttle movement as the power cylinder reciprocates the shuttle, a second cam follower driven by said shuttle driving said tape advance mechanism, and said closed periphery slots of said bearing block providing extensive flat bearing surfaces engaging the flat faces of said shuttle and shaft around their entire peripheries to maintain the shuttle and shaft in precise non rotatable paths.

8. The imprinter of claim 7, wherein the bearing block is a pair of mating component blocks each having an open face groove closed by the other component block to define the intersecting closed periphery slots.

* * * * *